United States Patent [19]

Krieger et al.

[11] 4,368,710

[45] Jan. 18, 1983

[54] APPARATUS FOR CONTROLLING THE OPERATING MIXTURE COMPOSITION IN INTERNAL COMBUSTION ENGINES

[75] Inventors: Klaus Krieger, Affalterbach; Volker Schneider, Waiblingen; Hans-Jörg Vogtmann, Markgröningen; Ludwig Walz, Stuttgart, all of Fed. Rep. of Germany

[73] Assignee: Robert Bosch GmbH, Stuttgart, Fed. Rep. of Germany

[21] Appl. No.: 203,750

[22] Filed: Nov. 3, 1980

[30] Foreign Application Priority Data

Nov. 2, 1979 [DE] Fed. Rep. of Germany ..... 2944166

[51] Int. Cl.[3] ..... F02M 63/00; F02M 7/00; F02M 25/06

[52] U.S. Cl. ..... 123/505; 123/571

[58] Field of Search ..... 123/453, 505, 571

[56] References Cited

U.S. PATENT DOCUMENTS

| | | | |
|---|---|---|---|
| 4,043,304 | 8/1977 | Stumpp et al. | 123/505 |
| 4,143,631 | 3/1979 | Stumpp | 123/505 |
| 4,284,047 | 8/1981 | Stumpp | 123/505 |

*Primary Examiner*—Wendell E. Burns

*Attorney, Agent, or Firm*—Edwin E. Greigg

[57] ABSTRACT

An apparatus is proposed for controlling the composition of the operating mixture in internal combustion engines. In this apparatus, a control of the air quantity is effected in accordance with the arbitrarily adjustable fuel quantity by throttling the air intake cross section and by remnant filling of the combustion chambers of the engine by means of recirculated exhaust gas. On the basis of the comparison of the aspirated air quantity with the injected fuel quantity by means of a differential pressure valve, a control pressure building up at a fixed throttle in a discharge line controlled by the differential pressure valve is generated as a control variable for an actuation device of the air throttle valve or for the exhaust recirculation valve in an exhaust recirculation line. On cold starting and warm-up of the engine, a substantially larger fuel quantity is simulated by the diversion of a portion of the compared fuel quantity, and thus a high control pressure is very rapidly attained, with the aid of which the fuel intake cross section is fully opened and the cross section of the exhaust recirculation line is completely closed. This diversion of the fuel is also effected, for instance at full load, whenever the intention is reliable prevention of exhaust recirculation.

8 Claims, 2 Drawing Figures

APPARATUS FOR CONTROLLING THE OPERATING MIXTURE COMPOSITION IN INTERNAL COMBUSTION ENGINES

BACKGROUND OF THE INVENTION

The invention is based on an apparatus for controlling the composition of the operating mixture to be introduced into the combustion chambers of internal combustion engines. In an apparatus of this kind, in accordance with the closed-loop control principle realized therein, the fresh-air intake cross section is closed by the throttle valve upon shutdown of the engine, and the exhaust recirculation valve is opened. Upon starting of the engine, an excess quantity of fuel is injected in a known fashion; this means that at this moment, because of the closed fresh-air intake cross section, there is insufficient air available for combustion in this fuel-guided, closed-loop control system. This causes problems in starting. But even after starting the engine, that is, during the warm-up phase, conditions for preparation of the fuel injected into the combustion chambers are still poor, so that recirculated exhaust gas hinders combustion. The effect is that so-called blue smoke appears in the engine exhaust, and the engine runs unevenly.

OBJECT AND SUMMARY OF THE INVENTION

The apparatus according to the invention has the advantage over the prior art that the exhaust recirculation is shut off in a simple manner during the critical starting and warm-up phases and the engine is supplied with the maximum possible amount of air.

As a result, advantageous modifications of and improvements to the apparatus disclosed are possible. It is particularly advantageous that a pressure regulating valve is inserted between the fuel supply line downstream of the metering cross section and the fuel supply line upstream of the metering cross section. Upon the attainment of a lower threshold value for the pressure in the fuel supply line downstream of the metering cross section, this pressure regulating valve furnishes a connection with the fuel supply line upstream of the metering cross section. Thus at low rpm and high load or a large injection quantity, conditions which prevail during starting and warm-up, the pressure in the fuel supply line downstream of the metering cross section does not fall below 0 and the injection pump still aspirates air. This is also true in the instance of acceleration out of a low-rpm status.

The invention will be better understood and further objects and advantages thereof will become more apparent from the ensuing detailed description of a preferred embodiment taken in conjunction with the drawing.

DESCRIPTION OF THE PREFERRED EMBODIMENT

Figure 1:
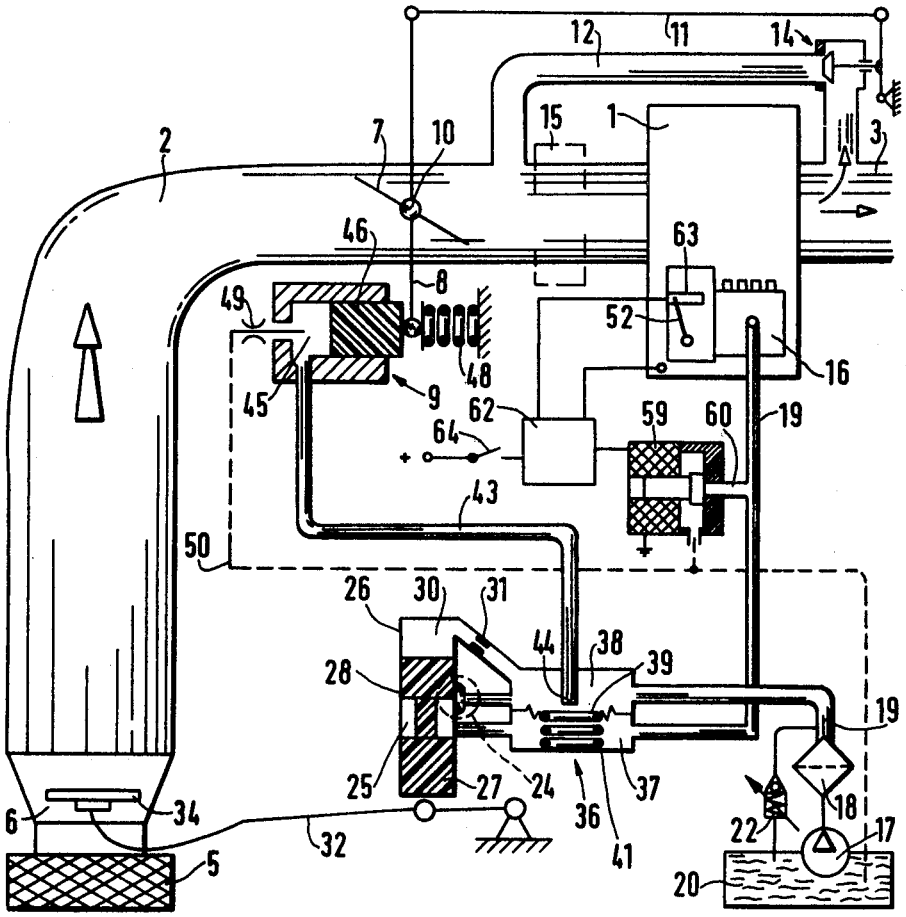
FIG. 1 shows one exemplary embodiment of the invention, which is described in detail below.

In the drawings, an internal combustion engine 1 is shown in simplified form, having an intake tube 2 and an exhaust manifold 3. At its inlet, the intake tube 2 is provided with an air filter 5 and adjacent thereto is embodied as an especially shaped funnel-like element 6 which widens in the flow direction toward the engine. A throttle valve 7 is disposed downstream therefrom in the intake tube 2, being connected via a linkage 8 with a hydraulic servomotor 9. Downstream of this throttle valve 7, an exhaust recirculation line 12 leading from the exhaust manifold 3 discharges into the intake tube 2. The cross section of the exhaust recirculation line 12 is controlled by an exhaust recirculation valve 14, which is coupled via a linkage 11 with the throttle valve shaft 10 and is actuated such that the cross section of the exhaust recirculation line 12 is closed whenever the cross section of the intake tube 2 is fully opened by the throttle valve 7. The engine 1 is equipped here as a self-igniting engine, and it is supplied with fuel in a known manner by an injection pump 16. This pump may be a series injection pump or a distributor-type injection pump. In a modified embodiment, a charger 15 may be disposed upstream or downstream of the discharge point of the exhaust recirculation line 12, for the purpose of compressing the aspirated air.

The injection pump 16 is supplied with fuel by a fuel supply pump 17 via a fuel supply line 19. The fuel supply pump 17 is followed directly by a fuel filter 18, and a pressure regulating valve 22 is provided parallel thereto and to the fuel supply pump 17 in a discharge line leading to the fuel supply container 20. With this pressure regulating valve 22, it is possible to attain a predetermined, substantially constant fuel supply pressure, which can additionally be influenced in long-term fashion in accordance with selected operational parameters such as air pressure or temperature.

A variable metering cross section 24 is provided in the fuel supply line 19, being embodied as a slit-like flow-through cross section of the fuel supply line 19, and discharges into an annular chamber 25 within a guide bore 26. The annular chamber 25 is formed by an outer annular groove of a control slide 27 displaceable in the guide bore 26. In accordance with the position of the control slide 27, one limiting edge 28 of the control slide 27 controls the free cross section of the slit-like metering cross section 24, extending in the direction of displacement of the control slide 27 in the wall of the guide bore 26. The fuel supply line 19, which cannot be closed by the control slide 27, leads off from the annular chamber 25 to the suction side of the injection pump 16.

On its end face, the control slide 27 encloses a pressure chamber 30 in the guide bore 26, which communicates via a throttle 31 with the fuel supply line upstream of the metering cross section 24. The control slide 27 is pressed against a pivoting arm 32 by the fuel pressure prevailing in this pressure chamber 30. The pivoting arm 32 is supported on one side and a baffle plate 34 lying across the air flow direction is secured on its free end protruding into the area of the air funnel 6. The baffle plate 34 is deflected by the impact pressure of the air flow, or by the pressure difference exerted upon it between the air pressure upstream and the air pressure downstream of the baffle plate, counter to the substantially constant force generated by the fuel pressure and transmitted by the control slide 27, until such time as a balance of forces has been established. With the aid of the specialized shaping of the air funnel 6, it can be attained that differing adjustment distances on the part of the baffle plate are required for the continuous enlargement of the free annular surface area between the baffle plate 34 and the air funnel wall, in order to maintain a constant pressure difference at the baffle plate 34.

On the other hand, the slit-like embodiment of the metering cross section 24 makes it possible for the metering cross section to vary linearly with the adjustment distance of the baffle plate 34. When the restoring force on the control slide 27 is held constant, it is thus possible to establish a desired ratio of air to fuel which is adapted to the various operational ranges of the engine.

The pressure drop at the metering cross section is controlled by a differential pressure valve 36. A first pressure chamber 37 communicates with the fuel supply line downstream of the metering cross section 24 and a second pressure chamber 38 communicates with the fuel supply line 19 upstream of the metering cross section 24. In the embodiment realized here, these pressure chambers are located directly in the fuel supply line. The two pressure chambers are separated from one another by a diaphragm 39, which is stressed on the side of the first pressure chamber 37 by a compression spring 41. A discharge line 43 projects perpendicularly relative to the surface of the diaphragm 39 into the second pressure chamber 38, and its opening 44 together with the diaphragm 39 provides a valve.

The discharge line 43, acting as a supply line for adjustment medium, leads into the work chamber 45 of the servomotor 9, whose adjustment device 46 is here embodied by way of example as a work piston and is under the influence of a compression spring 48 acting counter to the hydraulic adjustment pressure. The adjustment device, which may also be embodied by way of example as a diaphragm, is coupled with a linkage 8 for adjusting the throttle valve 7. The work chamber 45 also communicates, via a fixed throttle 49 located in a return flow line 50, with the fuel supply container 20.

The apparatus described above functions as follows:

Given a stationary operational state of the engine, if the quantity adjustment device of the injection pump 16 is adjusted via a lever 52 in the direction of a large fuel injection quantity, then more fuel must be delivered to the injection pump via the fuel supply line 19. With the control slide 27 being at first in a constant position, however, this leads to a sharper pressure drop at the metering cross section 24 and to a drop in pressure in the first pressure chamber 37 of the differential pressure valve. This valve serves as a comparator device, with which the actual fuel quantity delivered to the engine can be compared with the aspirated fresh-air quantity, which corresponds to the fuel quantity flowing across the metering cross section 24, given an established, required dependency of the fuel-air ratio. The pressure drop in the first pressure chamber 37 effects an adjustment of the diaphragm 39 and thus an enlargement of the opened cross section at the discharge opening 44 of the discharge line 43. The fuel discharge quantity, thus increased, causes an increase in the pressure being established at the throttle 49, which now being exerted in the work chamber 45 causes a displacement of the adjustment device 46 counter to the force of the compression spring 48. The throttle valve 7 is accordingly moved in the opening direction, which in turn leads to an increase in the supplied fresh-air quantity while simultaneously reducing the quantity of recirculated exhaust gas.

Now, because the intake tube flowthrough cross section has been enlarged at the throttle valve 7, the intake underpressure generated by the engine can be exerted more strongly at the baffle plate 34, so that the baffle plate 34 is further deflected under the influence of the briefly increased pressure difference, until a balance of forces again prevails at the pivoting arm 32 as a result of the enlargement of the free annular surface area or the reduction of the throttling at this flowthrough cross section. As a result of the displacement of the pivoting arm 32, the metering cross section 24 has also changed, so that the pressure drop determined by the design of the differential pressure valve is again established at the metering cross section. The change in the fuel quantity flowing out via the discharge line 43 corresponds to the result of a comparison between the fuel quantity actually supplied and the actual aspirated fresh-air quantity, or the deviation from the set-point value established at the differential pressure valve.

If the lever 52, in the opposite case, is set in the direction of a small fuel quantity or even a zero fuel quantity, then the feedback control procedure described above takes place in reverse sequence. The pressure in the first pressure chamber 37 at first increases because of the reduced fuel supply quantity to the fuel injection pump, so that the diaphragm 39 moves in the closing direction toward the opening 44 of the discharge line 43. Then, however, the pressure in the work chamber 45 is reduced such that the compression spring 48 moves the throttle valve 7 in the closing direction, until as a result of the corrective adjustment of the control slide 27 the pressure in the second pressure chamber 38 has been equalized appropriately.

When the engine is stopping, the control pressure in the work chamber 45 drops to 0, so that the throttle valve 7 is closed completely under the influence of the spring 48 and the exhaust recirculation valve 14 is fully opened. Accordingly, upon starting, the systemic pressure and the control pressure for the work chamber 45 must first be built up anew, and this occurs relatively slowly via the differential pressure valve 36. This causes problems in starting the engine, which during the starting phase aspirates the recirculated exhaust gas. But in the embodiment as so far described, exhaust gas is circulated in a feedback-controlled fashion even during the subsequent warm-up phase. However, the recirculation of exhaust gas hinders combustion during the warm-up phase, because the injected fuel cannot be optimally prepared and thus cannot be optimally completely combusted on account of the relatively low temperature then prevailing. In the realization according to the invention, therefore, a magnetic valve 59 is provided, which controls the cross section of a branch line 60, which in the illustrated embodiment branches off from the fuel supply line 19 located downstream of the metering cross section 24 and leads to the fuel supply container 20. This branch line 60 may instead, however, also lead off directly from the suction chamber of the fuel injection pump 16, for instance if this pump is a series injection pump. A flushing effect is thus attained, which can also be attained in the case of a distributor-type injection pump if the branch line branches off from the scavenging line leading back to the suction side of the distributor-type injection pump.

The magnetic valve 59 is controlled by a control device 62, which receives control signals characterizing the cold-starting situation of the engine, for instance, and the warm-up phase. The temperature of the engine can serve, by way of example, as a control signal for cold starting and for warm-up, with the position of the adjustment lever 52 being additionally usable for the starting situation. This can be effected by means of a distance transducer 63, as indicated in the drawings. The control device 62 is supplied with current via the starting switch 64 of the engine.

The apparatus functions as follows:

With the closing of the switch 64, the magnetic valve 59 is opened via the control device 62 whenever the engine is still cold. An additional fuel quantity flows in accordance therewith via the branch line 60 from the fuel supply line 19 located downstream of the metering cross section 24 to the fuel supply container 20. This has the spurious appearance of a very large fuel injection quantity, so that the discharge opening 44 is very quickly opened by the deflecting diaphragm 39, and a control pressure which causes the throttle valve 7 to open and the exhaust recirculation valve 14 to close is established in the work chamber 45 of the servomotor 9. Depending on the embodiment of the control device 62, the magnetic valve 59 can be kept open as long as the temperature of the engine is below a fixed set-point temperature value. However, it is also possible for the magnetic valve 59, upon ascertainment of the cold-starting situation, to be opened for a predetermined period, this being controlled by a timing element. The operating time then equals the expected length of time required by the engine for its warm-up phase. The operating time of the timing element may also be controlled in accordance with temperature.

A further possible use of the magnetic valve 59 is during full-load operation of the engine. Although the throttle valve 7 is opened fully by the closed-loop control apparatus during full-load operation, while the exhaust recirculation valve 14 is closed, the use of the magnetic valve makes it possible for this opening or closing procedure to be performed substantially faster than would be the case with the closed-loop control alone. This is important in the case of acceleration and also in order to assure that the exhaust recirculation will always be precluded during full-load operation. This is especially true for internal combustion engines having a turbocharger, which is known to have a deleterious effect on acceleration when large changes in load are involved. The full-load position can also be ascertained via the distance transducer 63 and converted by the control device 62 into a corresponding control signal for the magnetic valve 59.

Figure 2:
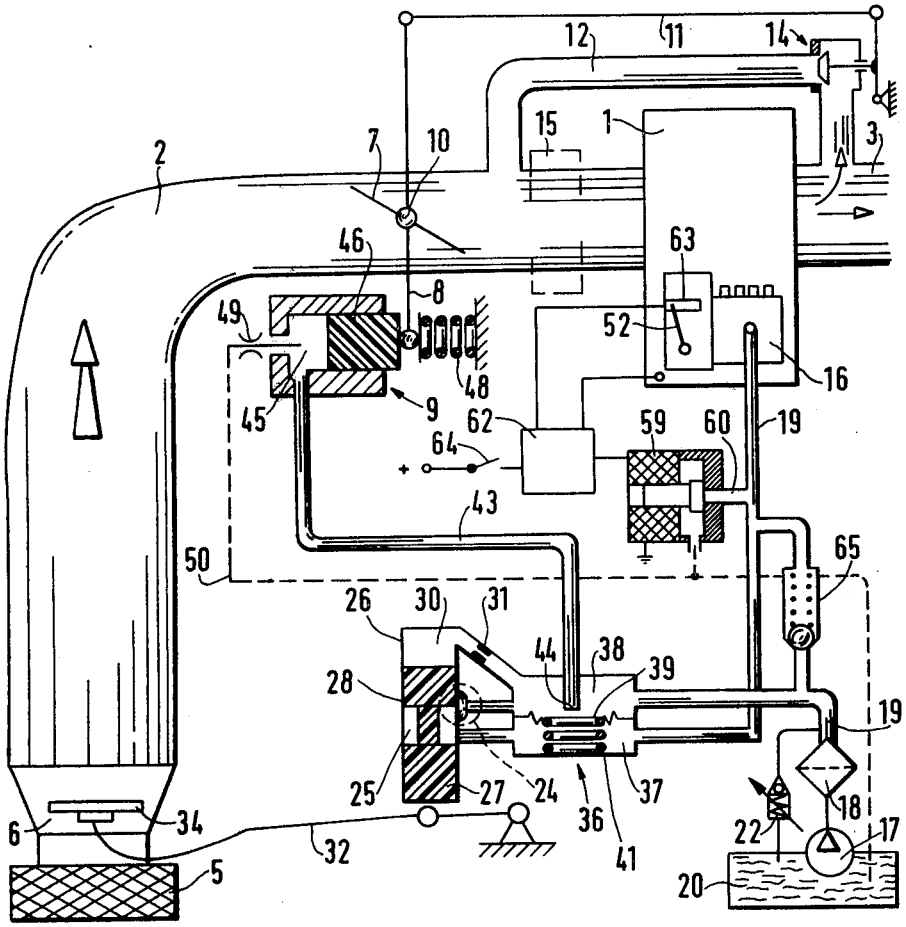
FIG. 2 is a modification of the embodiment shown in FIG. 1.

In a supplementary embodiment, as shown in FIG. 2 a pressure control valve 65 is further provided between the fuel supply line 19 located downstream of the metering cross section 24 and the fuel supply line 19 located upstream of the metering cross section 24. Upon failure to attain a lower threshold value for the fuel pressure in the fuel supply line 19 located downstream of the metering cross section 24, this pressure control valve 65 opens, thus furnishing communication between the two fuel supply line sections 19, until such time as the minimum pressure value has again been attained. This apparatus is also of substantial significance in the case of the closed-loop control apparatus described above which lacks the branch line 60 and the magnetic valve 59. At low rpm and at high load or with a large injection quantity, there is the danger in this fuel-guided system that the fuel pressure in the fuel supply line downstream of the metering cross section may drop below 0, because the fuel flow through the metering cross section 24 is at first too severely throttled. At such low pressures, there is the possibility that air will be aspirated by the fuel injection pump 16. The same problem occurs whenever additional relatively large quantities of fuel are carried away via the branch line 60. Thus with the aid of the pressure control valve 65, the situation is prevented where the pressure in the fuel supply line becomes too low and the functioning of the injection pump is disturbed by the aspiration of air.

The foregoing relates to a preferred exemplary embodiment of the invention, it being understood that other embodiments and variants thereof are possible within the spirit and scope of the invention, the latter being defined by the appended claims.

What is claimed and desired to be secured by Letter Patent of the United States is:

1. An apparatus for controlling the composition of the operating mixture to be introduced into the combustion chambers of an internal combustion engine comprising a fuel supply device, a fuel supply line, a fuel pump connected in said fuel supply line for supplying fuel at a constant pressure to an injection pump, an adjustable fuel metering apparatus connected in said fuel supply line, said fuel metering apparatus including a metering cross section, a throttle valve disposed in said fuel supply line leading away from said fuel supply device, said fuel metering apparatus being adjustable in accordance with an aspirated fresh air quantity, said fuel supply line upstream and downstream of said metering cross section arranged to communicate with a differential pressure valve having first and second chambers, a fuel discharge line controlled by means separating said first and second pressure chambers, a servomotor, said fuel discharge line connected to said servomotor and adapted to provide a control pressure upstream of a throttle in a fuel return line between said servomotor and said fuel supply device for controlling said servomotor, a fresh-air intake tube, a baffle element in said fresh-air intake tube arranged to control the fresh-air intake into said intake tube of said engine, further including a branch line provided downstream of the metering cross section of the fuel supply line, said branch line being connected between said fuel supply line and said fuel return line secured to said servomotor, said branch line including a cross section which is controlled in accordance with operational parameters of said engine.

2. An apparatus as defined by claim 1, characterized in that said cross section of said branch line is controlled by a magnetic valve.

3. An apparatus as defined by claim 2, characterized in that said magnetic valve is opened at temperatures of said engine below a minimum temperature by a control device actuated upon ignition of said engine.

4. An apparatus as defined by claim 2, characterized in that said magnetic valve is opened, by means of a control device actuated upon ignition of said engine and having an ajustable timing element for adjusting the operating time of the control device.

5. An apparatus as defined by claim 4, characterized in that the extent of operation of said timing element is dependent on the temperature of said engine.

6. An apparatus as defined by claim 3, characterized in that said magnetic valve is opened during full-load operation by said control device in accordance with the output signal of a full-load recognition device.

7. An apparatus as defined by claim 6, characterized in that said full-load recognition device is a transducer.

8. An apparatus for controlling the composition of the operating mixture to be introduced into the combustion chambers of an internal combustion engine comprising a fuel supply device, a fuel supply line, a fuel pump connected in said fuel supply line for supplying fuel at a constant pressure to an injection pump, an adjustable fuel metering apparatus connected in said fuel supply line, said fuel metering apparatus including a metering cross section, a throttle valve disposed in said fuel supply line leading away from said fuel supply device, said fuel metering apparatus being adjustable in accordance with an aspirated fresh air quantity, said fuel supply line upstream and downstream of said metering cross section arranged to communicate with a differential pressure valve having first and second chambers, a fuel discharge line controlled by means separating said first and second pressure chambers, a servomotor, said fuel discharge line connected to said servomotor and adapted to provide a control pressure upstream of a throttle in a fuel return line between said servomotor and said fuel supply device for controlling said servomotor, a fresh-air intake tube, a baffle element in said fresh-air intake tube arranged to control the fresh-air intake into said intake tube of said engine, further including a pressure control valve inserted in a line connected to said supply line upstream and downstream of said metering cross section, said pressure control valve arranged upon attainment of a predetermined threshold pressure value in the fuel supply line downstream of the metering cross section to furnish communication with the fuel supply upstream of the metering cross section.

* * * * *